US010100564B2

(12) United States Patent
Lapchev

(10) Patent No.: US 10,100,564 B2
(45) Date of Patent: Oct. 16, 2018

(54) HANDRAIL HINGE

(71) Applicant: Bend-tech Investments 1 Pty Ltd, Maddington Western Australia (AU)

(72) Inventor: Maria Lapchev, Morley (AU)

(73) Assignee: BEND-TECH INVESTMENTS 1 PTY LTD., Maddington (AU)

( * ) Notice: Subject to any disclaimer, the term of this patent is extended or adjusted under 35 U.S.C. 154(b) by 35 days.

(21) Appl. No.: 15/297,310

(22) Filed: Oct. 19, 2016

(65) Prior Publication Data

US 2018/0106085 A1 Apr. 19, 2018

(51) Int. Cl.

| | |
|---|---|
| ***E05D 11/10*** | (2006.01) |
| ***E05D 3/02*** | (2006.01) |
| ***E04F 11/18*** | (2006.01) |
| ***E02F 9/08*** | (2006.01) |

(52) U.S. Cl.

CPC ..... *E05D 11/1014* (2013.01); *E02F 9/0833* (2013.01); *E04F 11/1808* (2013.01); *E05D 3/022* (2013.01); *E05D 11/10* (2013.01); *E04F 2011/1876* (2013.01)

(58) Field of Classification Search

CPC .. E05D 3/022; E05D 3/12; E05D 3/18; E05D 11/1014; E05D 11/105; E05D 11/10; E02F 9/0833; E04F 11/1808; E04F 2011/1876; E05Y 2800/41

USPC ..... 16/348, 350, 357, 364

See application file for complete search history.

(56) References Cited

U.S. PATENT DOCUMENTS

| | | | | |
|---|---|---|---|---|
| 2,076,918 | A * | 4/1937 | Robison | F16L 37/248 285/148.13 |
| 3,419,295 | A * | 12/1968 | Small | A45B 17/00 135/114 |
| 3,512,211 | A * | 5/1970 | Eraclio | E05D 3/06 16/358 |
| 5,099,539 | A * | 3/1992 | Forester | A47L 1/06 15/144.3 |
| 6,364,562 | B1 * | 4/2002 | Tung | A45B 17/00 135/20.3 |
| 6,647,593 | B2 * | 11/2003 | Iguchi | A44C 5/12 16/278 |
| 7,412,985 | B2 * | 8/2008 | Ma | A45B 17/00 135/20.1 |
| 8,490,250 | B2 * | 7/2013 | Lanz | B25G 1/04 16/427 |
| 9,321,336 | B2 * | 4/2016 | Sasaki | A45B 25/00 |
| 2004/0036222 | A1 * | 2/2004 | Chou | A63B 63/004 273/407 |

* cited by examiner

*Primary Examiner* — Roberta S Delisle
(74) *Attorney, Agent, or Firm* — Kagan Binder, PLLC

(57) ABSTRACT

A hinge for a handrail requires two distinct movements for activation: an axial movement, followed by a rotational movement. The requirement for axial movement acts as a releasable lock on the hinge.

18 Claims, 4 Drawing Sheets

HANDRAIL HINGE

FIELD OF THE INVENTION

The present invention relates to hinges for handrails, such as handrails used outside the cabs of mobile equipment. The invention has been developed for use in handrails primarily within the mining industry, but is considered to have wider application.

BACKGROUND TO THE INVENTION

Many mining operations require the use of elevated platforms. These can be in fixed plant, or can be in mobile equipment, such as outside the cabs of diggers, loaders and the like.

To ensure workplace safety, these platforms are generally surrounded by handrails, to prevent a worker from falling from the platform.

In some instances, it is necessary for the handrail to be lowerable or removable, to permit ready access to the platform when desired. To this end, it is known to use hinged handrails which are moveable between an upright position and a lowered position.

Such hinged handrails require hinges which can be securely locked in the upright position, as a safety precaution, yet which can be quickly and easily moved into the lowered position when required. The hinges should be sturdy, damage resistant, and also long-lasting in dusty and potentially wet and even corrosive conditions.

It is also desirable that the hinge can be operated without the risk of entrapment of a worker's fingers.

The present invention seeks to provide a handrail hinge suitable for this purpose.

SUMMARY OF THE INVENTION

According to one aspect of the present invention there is provided a hinge for a handrail, the hinge including a first handrail portion and a second handrail portion, the first handrail portion including a receiving portion and the second handrail portion including an engaging portion arranged to be received in the receiving portion, the first handrail portion having a longitudinal axis which defines an axial direction, the second handrail portion being moveable relative to the first hand rail portion between a first position and a second position, and the second position and a third position; the second handrail portion being oriented in the axial direction in both the first and second positions, the second position being axially spaced from the first position, and the second handrail portion being rotated relative to the first handrail portion in the third position.

Preferably, the second handrail portion is constrained to move in the axial direction between the first and second positions.

In a preferred embodiment the receiving portion includes a positioning slot, the positioning slot having an axially aligned first portion and a generally circular second portion, the engaging portion having a positioning projection arranged to locate within the positioning slot, the positioning projection being sized and shaped such that it is restricted from rotating relative to the positioning slot when located in the first portion of the positioning slot, and is free to rotate relative to the positioning slot when located in the second portion of the positioning slot.

The positioning projection may have parallel side walls. The positioning projection may have arcuate end walls. In one embodiment, the end walls may be symmetrical. In an alternative embodiment, at least one end wall may be eccentric.

It will be appreciated that in an alternative embodiment the positioning slot may be located within the engaging portion and the positioning projection within the receiving portion.

It is preferred that the hinge includes two positioning slots and associated positioning projections, one diametrically spaced from the other.

The receiving portion may include a guiding slot, the guiding slot extending axially from an outer edge of the receiving portion. The engaging portion may have a guiding projection which locates within the guiding slot in the first position, and outside the guiding slot in the second and third positions.

It will be appreciated that in an alternative embodiment the guiding slot may be located within the engaging portion and the guiding projection within the receiving portion.

It is preferred that the hinge includes two guiding slots and associated guiding projections, one diametrically spaced from the other.

The receiving portion and the engaging portion may each be generally cylindrical in shape, with the receiving portion having a larger diameter than the engaging portion to allow the engaging portion to locate inside the receiving portion when in the first position.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
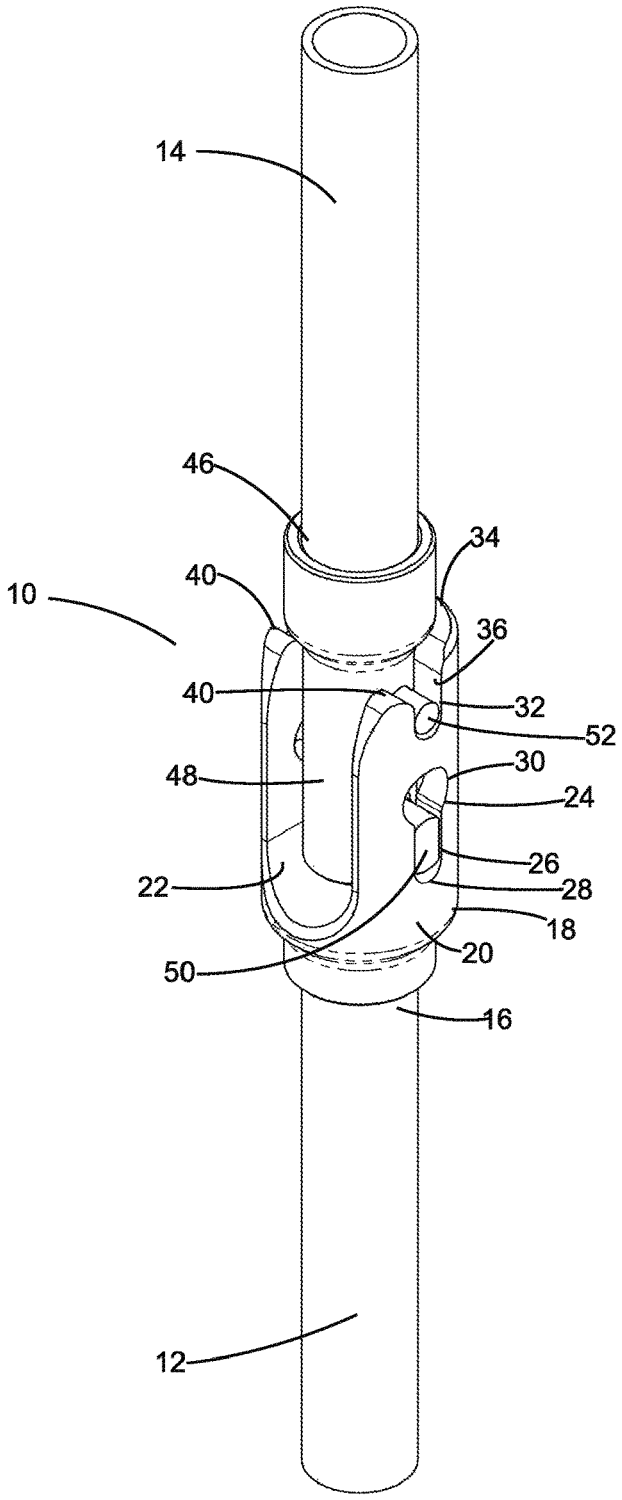
FIG. 1 is a perspective of a handrail hinge in accordance with a first embodiment of the present invention, shown in a first position.
Figure 2:
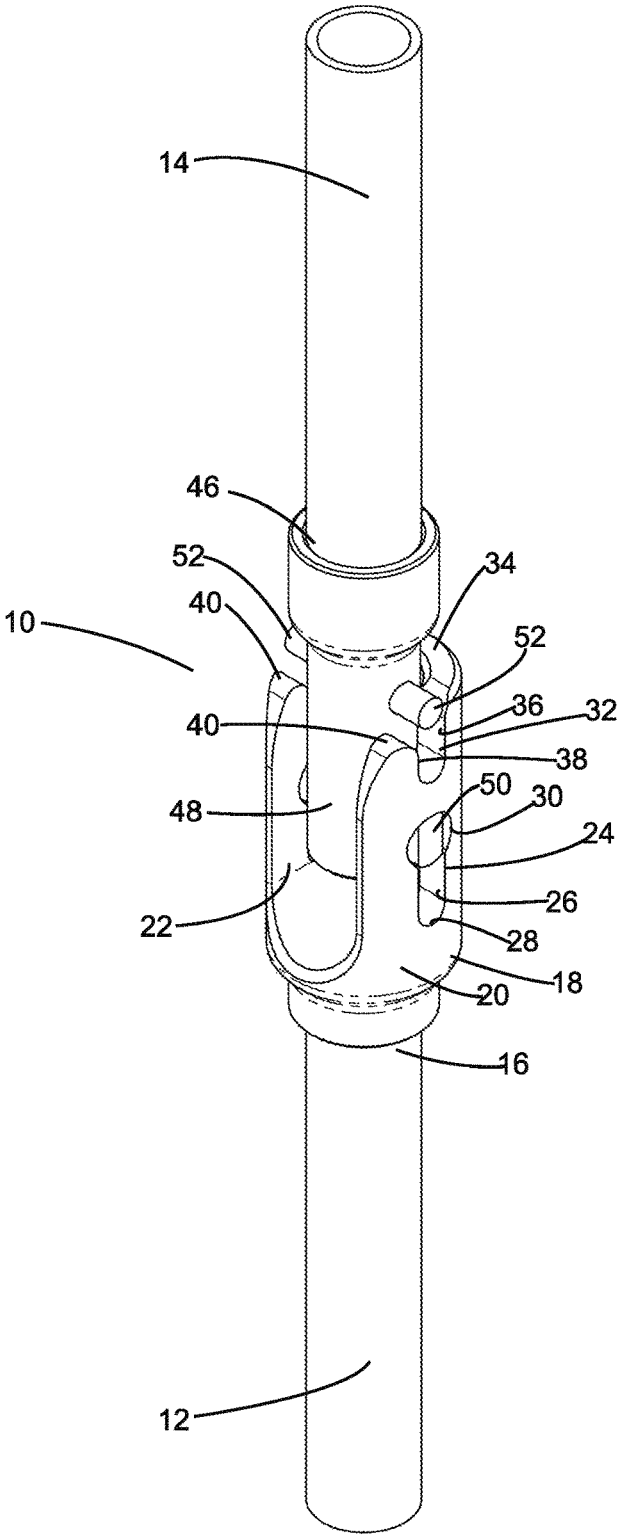
FIG. 2 is a perspective of the handrail hinge of FIG. 1, shown in a second position.
Figure 3:
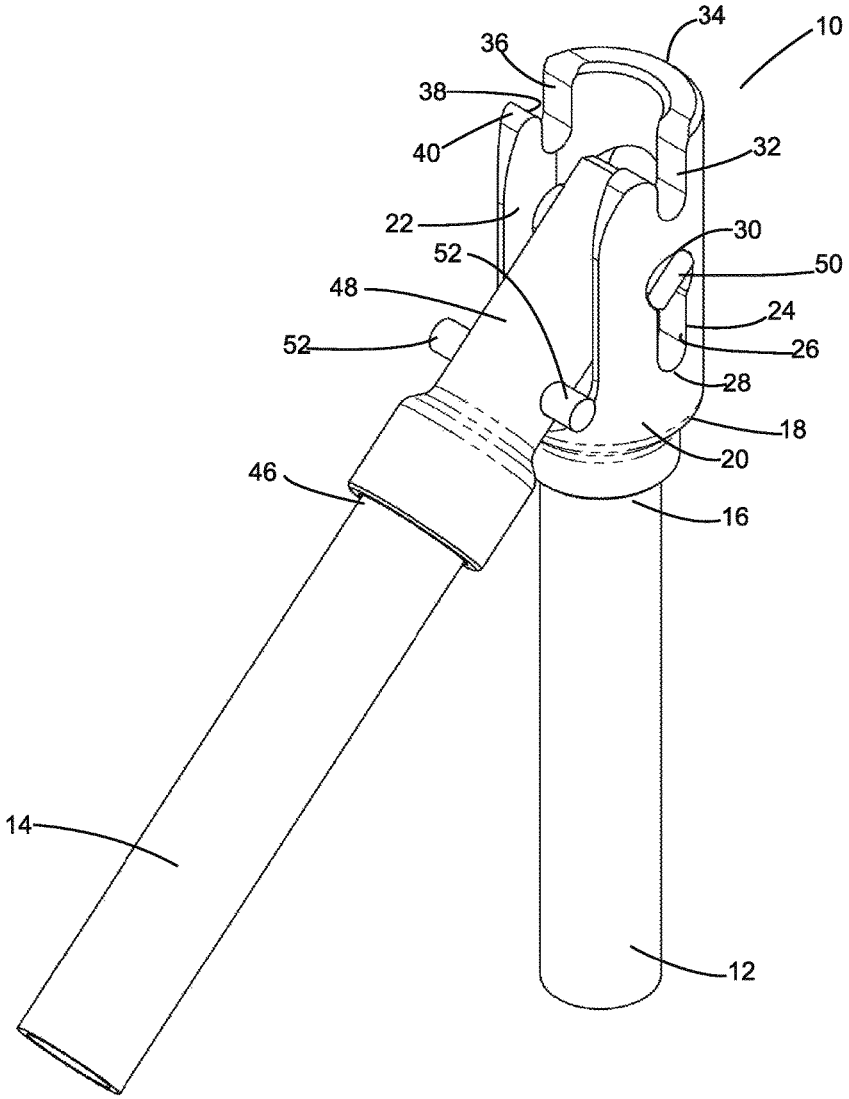
FIG. 3 is a perspective of the handrail hinge of FIG. 1, shown in a third position.

Referring to FIGS. 1 to 3, there is shown a handrail hinge 10 located within a handrail stanchion. The handrail stanchion has a fixed lower portion 12 and a moveable upper portion 14.

The lower portion 12 has an upper end 16, which acts as a first handrail portion of the hinge 10. The upper end 16 terminates in a receiving portion 18, which is a generally open cylindrical portion axially aligned with the lower portion 12, having a diameter greater than that of the remainder of the lower portion 12.

The receiving portion 18 has a side wall 20 which extends about 240° about the circumference, leaving a gap 22 of about 120°.

The receiving portion 18 has two positioning slots 24, diametrically spaced from each other and equidistant from the gap 22. Each of the positioning slots 24 has a first portion 26, which extends in an axial direction from a lower end 28 to an upper end, and a generally circular second portion 30 which is located at the upper end of the first portion 26.

The axial length of the first portion 26 is about equal to the diameter of the second portion 30. The width of the first portion 26 is about one third of the diameter of the second portion 30.

The receiving portion 18 has two guiding slots 32, each one axially aligned with a respective first portion 26 of a positioning slot 24. Each guiding slot 32 extends from an upper axial end 34 of the receiving portion 18 towards the corresponding positioning slot 24.

Each guiding slot 32 has a rear wall 36, and a front wall 38. The rear wall 36 is of full height; that is, it extends to the upper axial end 34 of the receiving portion 18. The length of the rear wall 36 is about equal to that of the first portion 26 of the positioning slot 24. The front wall 38, facing towards the gap 22, has a height about two thirds that of the rear wall 36. The front wall 38 terminates in a rounded edge 40, which curves towards the gap 22.

The upper portion 14 of the handrail stanchion has a lower end 46, which acts as a second handrail portion of the hinge 10. The lower end 46 terminates in an engaging portion 48, which is a generally cylindrical portion axially aligned with the upper portion 14, having a diameter less than that of the remainder of the upper portion 14.

The engaging portion 48 has two positioning projections 50, diametrically spaced from each other. The positioning projections 50 are generally rectangular in shape, with semicircular ends (that is, a geometrical stadium). More generally, the positioning projections can be described as having parallel side walls and arcuate end walls. The positioning projections 50 are similar in size and shape to the first portions 26 of the positioning slots 24.

The engaging portion 48 has two guiding projections 52, diametrically spaced from each other and axially aligned with the positioning projections 50. The guiding projections 52 are located axially internally of the positioning projections 50. The guiding projections 52 are generally circular, and are arranged to locate within the guiding slots 32.

The hinge 10 is assembled by locating the engaging portion 48 within the receiving portion 18, with the positioning projections 50 located within the positioning slots 24. Once assembled, the hinge 10 is moveable between three positions.

In the first position, as shown in FIG. 1, the upper portion 14 of the stanchion is axially aligned with the lower portion 12. This represents a closed, 'locked' configuration of the hinge 10.

In this first position the positioning projections 50 are located within the first portions 26 of the positioning slots 24, and the guiding projections 52 are located within the guiding slots 32. In this position, the upper portion 14 is restricted from rotational movement relative to the lower portion 12. It is free to move in only one direction: axially upwards.

Movement of the upper portion 14 in the upwards axial direction leads to the second position, as shown in FIG. 2. This position represents an intermediate configuration of the hinge 10.

In this position the positioning projections 50 are located within the second portions 30 of the positioning slot 24, and the guiding projections 52 are located above the front walls 38 of the guiding slots 32. From this position, the upper portion 14 can move in one of two ways: axially back to the first position, or rotationally about an axis defined by the second portions 30 of the positioning slots 24.

Rotation of the upper portion 14 from the second position leads to the third position, as shown in FIG. 3. This position represents a lowered configuration of the hinge 10.

It will be appreciated that rotation can only occur in one direction; that is, with engaging portion 48 moving within the gap 22 of the receiving portion 18, and the guiding projections 52 moving across the front walls 38 of the guiding slots 32 into an unconstrained location. The second portions 30 of the positioning slots 24 act as a bearing within which the rounded outer ends of the positioning projections 50 can rotate.

The hinge can be readily returned to its locked configuration by rotating the upper portion 14 back to the intermediate configuration, and then lowering the upper portion in an axial direction.

Figure 4:
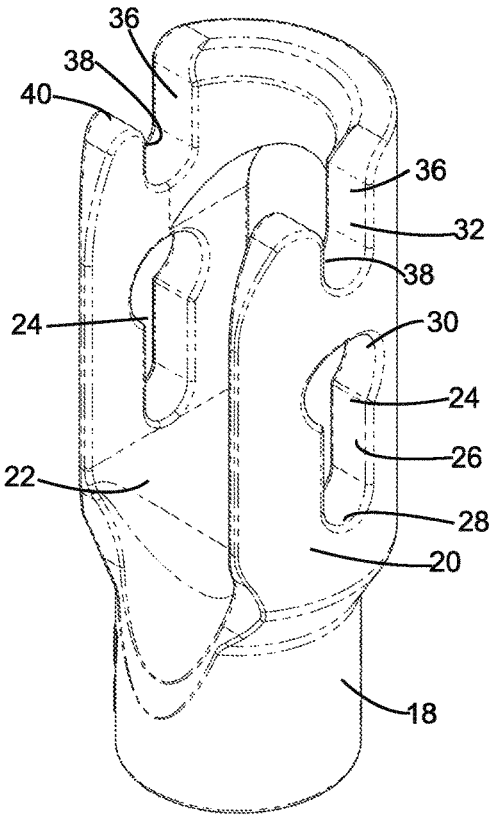
FIG. 4 is a perspective of a receiving portion from a handrail hinge in accordance with a second embodiment of the present invention.
Figure 5:
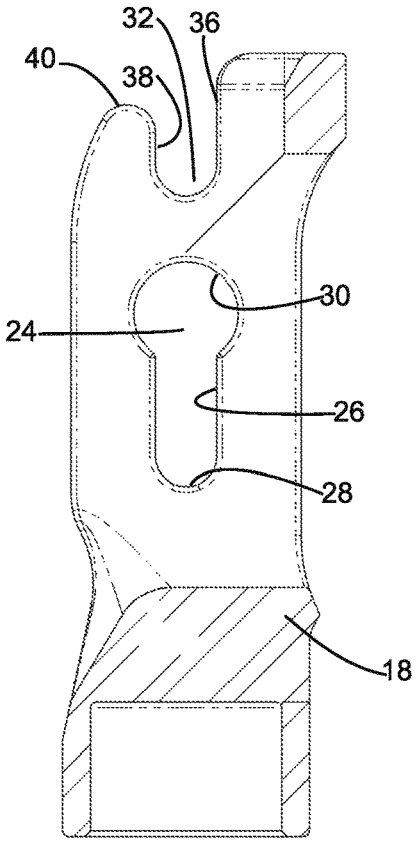
FIG. 5 is a cross sectional view through the receiving portion of FIG. 4.
Figure 6:
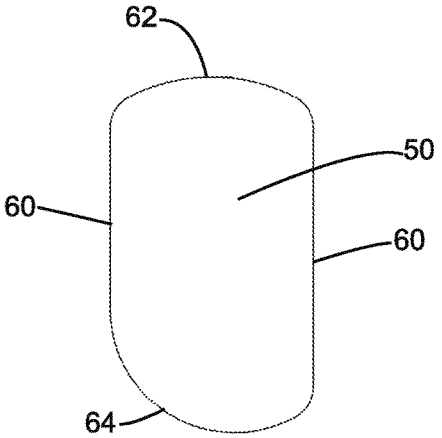
FIG. 6 is an end view of a positioning projection for use in connection with the receiving portion of FIG. 4.

FIGS. 4 to 6 show a second embodiment of the handrail hinge 10, with a receiving portion 18 which has been created with smoother edges ready for production. The receiving portion 18 has positioning slots 24 which have longer first portions 26 than those shown in the first embodiment. It will be appreciated that this translates into a longer axial 'stroke' during movement of the hinge from the first position to the second position.

The positioning projection 50 designed for use in this embodiment is shown in cross section in FIG. 6. The positioning projection 50 has two parallel side walls 60, and an arcuate upper end wall 62, similar to that of the first embodiment. The positioning projection 50 of this embodiment has an eccentric arcuate lower end wall 64, having a radius of curvature less than that of the upper end wall 62 (and that of the second portion 30 of the positioning slots 24).

It will be appreciated that this arrangement reduces the degree of contact between the positioning projection 50 and the second portion 30 of its associated positioning slot 24 during movement from the second position to the third position of the hinge 10. This reduction in contact corresponds to a reduction in friction, making the movement easier to achieve.

Modifications and variations as would be apparent to a skilled addressee are deemed to be within the scope of the present invention.

The invention claimed is:

1. A hinge for a handrail, the hinge including a first handrail portion and a second handrail portion, the first handrail portion including a receiving portion and the second handrail portion including an engaging portion arranged to be received in the receiving portion, the first handrail portion having a longitudinal axis which defines an axial direction, the second handrail portion being moveable relative to the first hand rail portion between a first position and a second position, and the second position and a third position; the second handrail portion being oriented in the axial direction in both the first and second positions, the second position being axially spaced from the first position, wherein the second handrail portion is constrained to move in the axial direction between the first and second positions, and the second handrail portion being rotated relative to the first handrail portion in the third position, wherein the receiving portion includes a positioning slot, the positioning slot having an axially aligned first portion and a generally circular second portion, the engaging portion having a positioning projection arranged to locate within the positioning slot, the positioning projection being sized and shaped such that it is restricted from rotating relative to the positioning slot when located in the first portion of the positioning slot, and is free to rotate relative to the positioning slot when located in the second portion of the positioning slot.

2. A hinge for a handrail as claimed in claim 1, wherein the positioning projection has parallel side walls.

3. A hinge for a handrail as claimed in claim 1, wherein the positioning projection has arcuate end walls.

4. A hinge for a handrail as claimed in claim 3, wherein at least one end wall is eccentric.

5. A hinge for a handrail as claimed in claim 1, wherein the hinge includes two positioning slots and associated positioning projections, one diametrically spaced from the other.

6. A hinge for a handrail as claimed in claim 1, wherein the receiving portion includes a guiding slot, the guiding slot extending axially from an outer edge of the receiving portion.

7. A hinge for a handrail as claimed in claim 6, wherein the engaging portion has a guiding projection which locates within the guiding slot in the first position, and outside the guiding slot in the second and third positions.

8. A hinge for a handrail as claimed in claim 6, wherein the hinge includes two guiding slots and associated guiding projections, one diametrically spaced from the other.

9. A hinge for a handrail as claimed in claim 1, wherein the engaging portion includes a guiding slot, the guiding slot extending axially from an outer edge of the engaging portion.

10. A hinge for a handrail as claimed in claim 9, wherein the receiving portion has a guiding projection which locates within the guiding slot in the first position, and outside the guiding slot in the second and third positions.

11. A hinge for a handrail as claimed in claim 1, wherein the receiving portion and the engaging portion are each generally cylindrical in shape, with the receiving portion having a larger diameter than the engaging portion to allow the engaging portion to locate inside the receiving portion when in the first position.

12. A hinge for a handrail, the hinge including a first handrail portion and a second handrail portion, the first handrail portion including a receiving portion and the second handrail portion including an engaging portion arranged to be received in the receiving portion, the first handrail portion having a longitudinal axis which defines an axial direction, the second handrail portion being moveable relative to the first hand rail portion between a first position and a second position, and the second position and a third position; the second handrail portion being oriented in the axial direction in both the first and second positions, the second position being axially spaced from the first position, wherein the second handrail portion is constrained to move in the axial direction between the first and second positions, and the second handrail portion being rotated relative to the first handrail portion in the third position, wherein the engaging portion includes a positioning slot, the positioning slot having an axially aligned first portion and a generally circular second portion, the receiving portion having a positioning projection arranged to locate within the positioning slot, the positioning projection being sized and shaped such that it is restricted from rotating relative to the positioning slot when located in the first portion of the positioning slot, and is free to rotate relative to the positioning slot when located in the second portion of the positioning slot.

13. A hinge for a handrail as claimed in claim 12, wherein the receiving portion includes a guiding slot, the guiding slot extending axially from an outer edge of the receiving portion.

14. A hinge for a handrail as claimed in claim 13, wherein the engaging portion has a guiding projection which locates within the guiding slot in the first position, and outside the guiding slot in the second and third positions.

15. A hinge for a handrail as claimed in claim 13, wherein the hinge includes two guiding slots and associated guiding projections, one diametrically spaced from the other.

16. A hinge for a handrail as claimed in claim 12, wherein the engaging portion includes a guiding slot, the guiding slot extending axially from an outer edge of the engaging portion.

17. A hinge for a handrail as claimed in claim 16, wherein the receiving portion has a guiding projection which locates within the guiding slot in the first position, and outside the guiding slot in the second and third positions.

18. A hinge for a handrail as claimed in claim 12, wherein the receiving portion and the engaging portion are each generally cylindrical in shape, with the receiving portion having a larger diameter than the engaging portion to allow the engaging portion to locate inside the receiving portion when in the first position.

* * * * *